United States Patent [19]

Mamrosov et al.

[11] 4,456,175

[45] Jun. 26, 1984

[54] NOZZLE ASSEMBLY FOR LIQUID SPRAYING IN COKE OVEN ASCENSION PIPE

[75] Inventors: Alexandr D. Mamrosov; Oleg V. Fedulov; Alexandr S. Kolivashko; Boris I. Meniovich, all of Dnepropetrovsk; Vladimir A. Neboga, Donetsk, all of U.S.S.R.

[73] Assignee: Dnepropetrovsky Khimiko-Tekhnologichesky Institut Imeni F. E. Dzerzhinskogo, Dnepropetrov, U.S.S.R.

[21] Appl. No.: 327,265

[22] Filed: Dec. 3, 1981

[51] Int. Cl.[3] ..... B05B 7/10

[52] U.S. Cl. ..... 239/113; 202/254; 202/255; 202/256; 239/404; 239/489; 239/549

[58] Field of Search ..... 202/254, 255, 256; 239/106, 112, 403, 404, 470, 489, 497

[56] References Cited

FOREIGN PATENT DOCUMENTS 410656 4/1945 Italy ..... 239/403

345936 8/1972 U.S.S.R. .

*Primary Examiner*—John J. Love

*Assistant Examiner*—Jon M. Rastello

*Attorney, Agent, or Firm*—Murray Schaffer

[57] ABSTRACT

A body is provided with at least two cylindrical swirl chambers used to form a liquid spray cone for injecting charge gases resulting from charging coal to the coke oven, and a liquid spray cone for cleaning coke-oven gas passing through the coke oven ascension pipe. The swirl chambers are made of different diameters and each has a separate tangentially oriented inlet and a separate axially directed spray nozzle. The chambers communicate with one another through a by-pass passage to provide flow of liquid from one swirl chamber to another one.

4 Claims, 4 Drawing Figures

NOZZLE ASSEMBLY FOR LIQUID SPRAYING IN COKE OVEN ASCENSION PIPE

BACKGROUND OF THE INVENTION

1. Field of the Invention

The invention relates to equipment for the production of coke by-products and particularly concerns a nozzle for spraying liquid in a coke oven ascension pipe.

2. The Prior Art

It is known in the art to construct nozzles for liquid spraying so that they atomize a liquid to form one spray cone with the angle thereof being constant.

For instance, there is known a nozzle assembly for liquid spraying (cf. the USSR Author's Certificate No. 345,936, Int. Cl. B05b 9/00, 1972), which comprises a body accomodating a swirl chamber having a tangential and an axial inlets to pass the liquid thereinto, and a spray nozzle.

The liquid is fed into the swirl chamber through both inlets, the greater portion of the liquid being introduced through the tangentially directed inlet. In the swirl chamber the liquid is swirled along the walls thereof and is passed therefrom through the spray nozzle to form a hollow spray cone. The smaller portion of the liquid is fed into the swirl chamber through the axially directed inlet and is passed then therefrom through a spray nozzle in a continuous jet surrounded by the hollow spray cone to thereby form one filled spray cone.

When used in the coke by-product industry the nozzle assembly for liquid spraying is mounted in the pipe bend of the coke oven ascension pipe by which charge gases are conveyed from the ascension pipe into a gas collector, and operated only for the period that charging coal into the coke oven, which period lasts 3–4 minutes. During carbonization which takes 15–18 hours, the nozzle does not operate. During the whole period of the coking process a hot coke-oven gas flows into the gas collector through the ascension pipe bend, passing under the nozzle. The coke-oven gas carries suspended therein solid particles of pitchy and other substances, which particles settle down on the pipe bend walls under the nozzle to form heavy coal-tar products and pass through the spray nozzle into the swirl chamber in which they settle down during the period of 15–18 hours, that is when it does not operate, thereby clogging the swirl chamber.

In order to prevent clogging of the nozzle the coke-oven gas must be constantly cleaned from the particles of pitchy and other substances suspended therein.

To this end it is necessary to spray a liquid in the pipe bend of the coke oven ascension pipe, with the liquid spray cone angle being greater than the angle of a liqud spray cone for injecting the charge gases, which would allow cleaning the coke-oven gas under the nozzle over the whole open area and height of the bend of the ascension pipe. The liquid spray cone should be caused to coincide with the spray cone of the liquid for injecting charge gases or to be located close thereto so that not to disturb the injection of the charge gases during charging coal into the coke oven, so as to simultaneously effect spraying both the liquid for injecting the charge gases and the liquid for cleaning the coke-oven gas and the acension pipe bend.

Nozzles for spraying liquid, disposed in the ascension pipe bend close to each other and having swirl chambers made to different diameters to form spray cones of different angles do not allow these spray cones to be caused to coincide or located as close to each other as possible, since the swirl chambers of these nozzle assemblies and spray nozzles thereof are located at a great distance from each other because of the overall dimensions of these nozzle assemblies.

An object of the invention is to provide a nozzle assembly for spraying a liquid in a coke oven ascension pipe, which is reliable in operation during injection of coke-oven charge gases.

Another object of the invention is to provide cleaning the walls of the coke oven ascension pipe.

An additional object of the invention is to vary an angle of a liquid-spray cone in the nozzle assembly.

SUMMARY OF THE INVENTION

These and other objects of the invention are attained in a nozzle assembly for spraying a liquid in the ascension pipe of a coke oven, which comprises a body; at least two cylindrical swirl chambers made in the body to different diameters, each said swirl chamber having a separate tangentionally directed inlet and a separate axially directed spray nozzle; a by-pass passage communicating said swirl chambers with one another.

During the entire period of carbonization the additional swirl chamber is used to provide, in the coke oven ascension pipe bend, a liquid spray cone to clean the coke-oven gas passing under the nozzle assembly from the coke oven into the gas collector, from particles of pitchy and other substances suspended in said coke-oven gas.

In this case the second swirl chamber which operates only to provide injection of the charge gases during the charging of coal into the coke oven is continuously washed by the flow of the liquid passing thereinto through the by-pass passage from the continually operating additional swirl chamber, which rules out clogging of the second swirl chamber by solid particles of pitchy and other substances and thus ensures a reliable operation thereof in injecting the charge gases when the coke oven is charged.

Since the swirl chambers are arranged within one body and have different diameters the liquid in such nozzle assembly is sprayed in two spray cones of different angles, located close to each other, which provides for cleaning the coke-oven gas of suspended solid particles of pitchy and other substances along the whole height of the ascension pipe bend during the entire period of cabonization and during injection of the charge gases when the coke oven is charged with coal.

In addition, a continuous spraying in the ascension pipe bend by one of the swirl chambers which operates continuously provides for continuously washing away heavy coal-tar products and pitchy substances from the walls of the ascension pipe bend and a poppet valve mounted therein, and bringing down the temperature of the coke-oven gas by 10°–15° C.

It is expedient to make the by-pass passage along a line tangent to the cylindrical walls of the swirl chambers.

Flowing of liquid from one of the swirl chambers into another one through a passage will cause the liquid to swirl in the chamber through which it passes to thereby facilitate cleaning the latter. When all the swirl chambers operate simultaneously said flowing of liquid between said swirl chambers increases the rate of injection of the charge gases due to the presence of an additional liquid spray cone.

It is desirable that said swirl chambers be provided with swirlers made in the form of cylindrical inserts having therein lateral inclined grooves, with the groove inclination angles being different for different swirlers.

Such construction permits, if necessary, varying the spray-cone angle of the liquid flowing from the swirl chamber.

BRIEF DESCRIPTION OF THE DRAWINGS

The above-mentioned and other features and objects of this invention will become more apparent by reference to the following description of an embodiment of the invention taken in conjunction with the accompanying drawings, in which.

DESCRIPTION OF THE PREFERRED EMBODIMENT OF THE INVENTION

A nozzle assembly for spraying a liquid in the bend of a coke oven ascension pipe comprises a cylindrical body 1 (FIG. 1), wherein a cylindrical swirl chamber 2 is disposed to atomize a liquid for injection of the coke-oven charge gases. According to the invention the body 1 also accomodates an additional swirl chamber 3 to atomize a liquid for cleaning a coke-oven gas.

Each swirl chamber 2, 3 has a swirler mounted therein, which swirler is made in the form of a cylindrical insert having lateral inclined grooves 6, 7 respectively (FIGS. 1, 2), the angles of inclination of the grooves 6, 7 and dimensions of the grooves of the swirlers being different.

Figure 1:
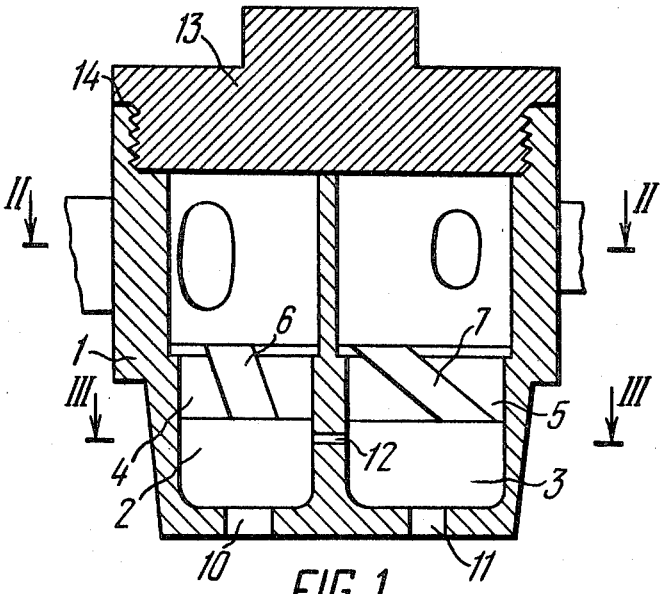
FIG. 1 is a section of a nozzle assembly for spraying liquid in a coke-oven ascension pipe according to the invention.
Figure 2:
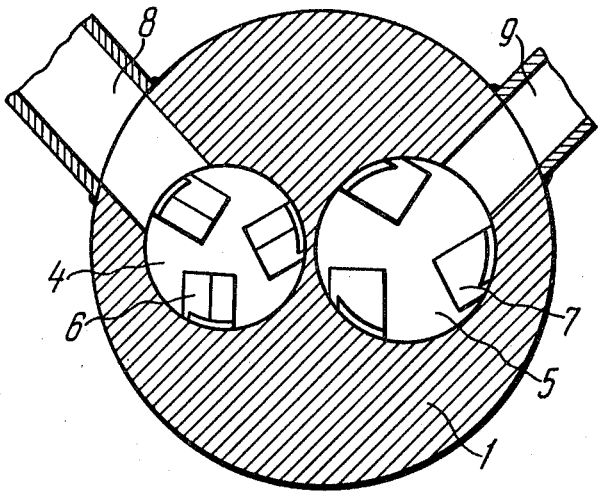
FIG. 2 is a section of a nozzle assembly of the invention taken along line II—II of FIG. 1.

Each swirl chamber 2,3 has separate tangentially oriented inlet 8, 9 respectively (FIG. 2) and axially oriented spray nozzle 10, 11 respectively (FIG. 1).

Figure 3:
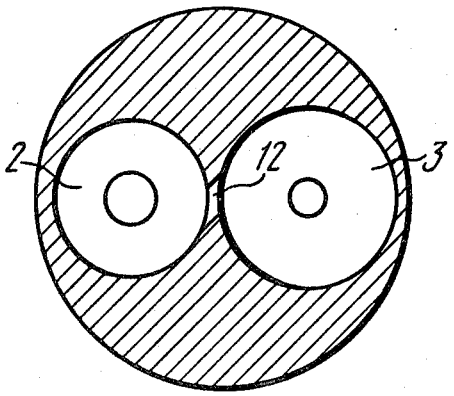
FIG. 3 is a section of a nozzle assembly of the invention, taken along line III—III of FIG. 1.

The swirl chambers 2 and 3 communicate with each other through a by-pass passage 12 (FIGS. 1, 3) provided in the body 1 under the swirlers 4 and 5 (see FIG. 1). The by-pass passage 12 is made along a line tangent to the cylindrical walls of the swirl chambers 2 and 3.

The body 1 (FIG. 4) is provided with a cover 13 and gasket 14.

Figure 4:
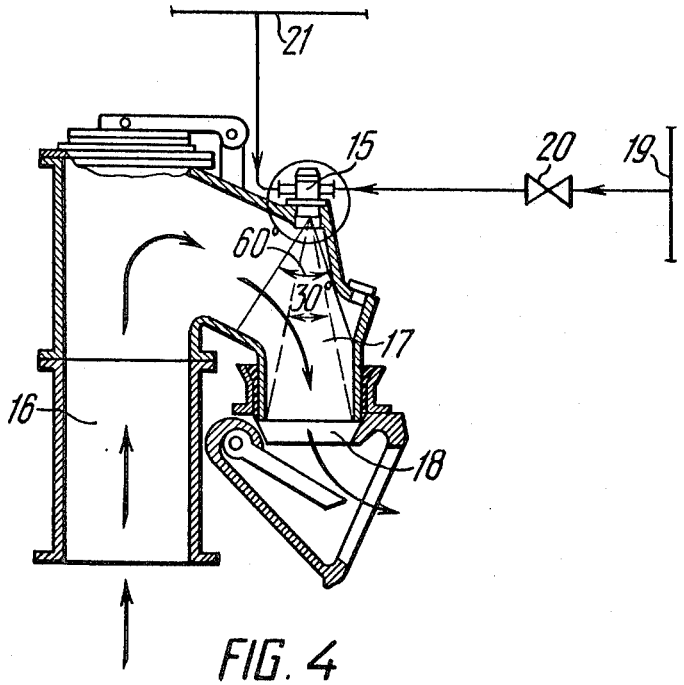
FIG. 4 shows a coke oven ascension pipe wherein is mounted a nozzle assembly of the invention.

The nozzle assembly 15 (FIG. 4) for spraying liquid into the ascension pipe of a coke oven is mounted on the ascension pipe which consists of a stand pipe proper 16 a lower portion of which communicates with the coking chamber at the top thereof (not shown in FIG. 4), and a pipe bend 17 wherein a poppet valve 18 is mounted, which poppet valve is connected with a gas collector (not shown in FIG. 4). The nozzle assembly 15 is connected through branch pipes 8, 9 (FIG. 2) to a high-pressure water pipe line 19 through a water injection tap 20 and to low-pressure water pipe line 21 respectively.

The nozzle assembly of the invention operates in the following manner.

Prior to charging the coke oven with coal (not shown in the drawings) an ammonia liquor is fed under pressure of 15–20 atm from the pipe line 19 (FIG. 4) through the tap 20 and the tangential inlet 8 (FIG. 2) into the swirl chamber 2 (FIG. 1) of the nozzle assembly 15 (FIG. 4).

In the swirl chamber 2 (FIG. 1) said ammonia liquor is passed onto the swirler 4, wherein in the lateral inclined grooves thereof it is caused to swirl and is forced from the swirl chamber 2 through the axial spray nozzle 10 into the bend 17 of the ascension pipe 16, with the liquor spray-cone angle being 30°. This spray cone covers the entire clear opening area of the pipe bend 17 close to the poppet valve 18 mounted in the lower portion of the bend 17 of the ascension pipe 16, thereby providing the injection of the charge gases from the ascension pipe 16 into the gas collector (not shown in the drawings) through the bend 17 during the whole period of charging a coal into the coke oven.

After charging coal into the coke oven is finished, which charging lasts 3–4 minutes, the tap 20 is closed to stop the flow of said ammonia liquor into the swirl chamber 2.

The spray-cone angle of 30° in the swirl chamber 2 is formed by properly selecting a size and angle of inclination of the lateral inclined grooves 6 of the swirler 4, a diameter of the swirl chamber 2 and that of the spray nozzle 10.

During the entire period of charging coal into the coke oven and coking process the ammonia liquor is fed under a pressure of 2–3 atm from the pipe line 21 (FIG. 4) through the tangential inlet 9 (FIG. 2) into the swirl chamber 3 (FIG. 1), wherein passing through the lateral inclined grooves 7 of the swirler 5 the ammonia water is caused to swirl and is forced through the axial spray nozzle 11 from the swirl chamber 3 to form a spray cone in the bend 17 of the ascension pipe 16, with the angle of said spray cone being 60°.

Similarly as in the previous case, the spray-cone angle of 60° in the swirl chamber 3 (FIG. 1) is formed by properly selecting a size and angle of inclination of the lateral inclined grooves 7 of the swirler 5, a diameter of the swirl chamber 3 and that of the spray nozzle 11.

This spray cone covers the whole clear area at the top portion of the bend 17 (FIG. 4) of the ascension pipe 16 immediately under the nozzle assembly 15 so as to spray the coke-oven gas flowing from the ascension pipe 16 through the bend 17 into the gas collector (not shown in the drawings) and to thereby clean it over the whole height of the bend 17 from suspended particles of pitchy and other substances, and bring down the temperature of said coke-oven gas by 10°–15° C., thus improving the operational reliability of the nozzle assembly.

In addition, said liquid spray cone washes away heavy coal-tar products and graphite from the walls of the ascension pipe bend.

During the coking process the swirl chamber 2, as mentioned above, does not operate, and the ammonia water is supplied only to the swirl chamber 3 (FIG. 1), wherefrom it is passed through the by-pass passage 12 into the swirl chamber 2. Due to the fact that the passage 12 is made along a line tangent to the cylindrical walls of the swirl chambers 2,3 the ammonia water while passing through this passage 12 under pressure of 2–3 atm from the swirl chamber 3 into the swirl chamber 2 is caused to swirl, as a result of which it continuously washes and thereby cleans the walls of the swirl chamber 2, whereafter it passes through the spray nozzle 10 into the bend 17 of the ascension pipe 16.

Through the same passage 12 from the swirl chamber 2 into the swirl chamber 3 ammonia water which is supplied under the pressure of 15–20 atm into the swirl chamber 2, when the coke oven is charged with coal (not shown in the drawings), for injecting the charge gases from the ascension pipe 16 into the pipe bend 17 and further to the gas collector (not shown in the drawings).

From the swirl chamber 2 the ammonia water is passed into the swirl chamber 3 through the passage 12 in the direction which is opposite to the direction of swirling of the ammonia water when it is fed through the tangential inlet into the swirl chamber 3, with the result that it disturbs and slows down the swirling of the ammonia water flow in the swirl chamber 3, to thereby form therein an additional spray cone, with the angle of said additional spray cone being 30°. This additional spray cone passing from the chamber 3 facilitates the injection of the charge gases, during operation of the swirl chamber from the ascension pipe 16 into the gas collector (not shown in the drawings) when the coke oven is charged with coal. Increasing the rate of injection in this way allows the ammonia water pressure in the nozzle assembly 15 to be decreased.

The invention may be varied and otherwise embodied within the scope of the appended claims.

We claim:

1. A nozzle for spraying at least two liquid portions into the ascension pipe of a coke oven comprising:

a body at least two cylindrical swirl chambers, said chambers being spaced laterally from each other and having different diameters, each chamber having a separate tangential inlet adapted for communication with the source of a respective one of said liquid portions and a separate axial spray outlet adapted for independent communication with said ascension pipe; and a by-passing passage extending between said chambers for the flow of liquid therebetween.

2. The nozzle according to claim 1 wherein said by-pass passage extends in a line tangential to the walls of each of the chambers communicating therewith.

3. The nozzle according to claim 1 including a swirler located in each chamber, said swirliers comprising a body insertable in said chamber and having laterally inclined grooves, the angle of inclination of said grooves in each swirler body insert being different.

4. The nozzle according to claim 2 including a swirler located in each chamber, said swirliers comprising a body insertable in said chamber and having laterally inclined grooves, the angle of inclination of said grooves in each swirler body insert being different.

* * * * *